United States Patent [19]

Turner, Jr.

[11] 4,012,853

[45] Mar. 22, 1977

[54] FOREPART INSOLE RING SHOE CONSTRUCTION

[75] Inventor: Newton C. Turner, Jr., Nashville, Tenn.

[73] Assignee: Genesco. Inc., Nashville, Tenn.

[22] Filed: May 20, 1976

[21] Appl. No.: 688,227

[52] U.S. Cl. ..... 36/17 R

[51] Int. Cl.[2] ..... A43B 13/18

[58] Field of Search ..... 36/17 R, 17 PW; 12/142 D

[56] References Cited

UNITED STATES PATENTS

| | | | |
|---|---|---|---|
| 1,161,323 | 11/1915 | Pierce | 36/17 R |
| 1,620,612 | 3/1927 | McKibben | 36/17 R X |
| 2,021,192 | 11/1935 | Miller | 36/17 R |
| 2,072,216 | 3/1937 | Ross | 36/17 R |
| 2,132,882 | 10/1938 | Rigandi | 36/17 R X |
| 2,826,770 | 3/1958 | Freeman | 36/17 R X |
| 3,133,360 | 5/1964 | Taylor | 36/17 R |

*Primary Examiner*—Alfred R. Guest
*Attorney, Agent, or Firm*—Harrington A. Lackey

[57] ABSTRACT

A shoe construction in which a forepart insole ring member is secured between the forepart portion of the upper and the forepart portion of the outsole. The rear portion of the ring member extends transversely of the shoe in the ball area. A resilient pad or raised portion of the forepart of the outsole projects through the hole formed by the inner edge of the ring member.

6 Claims, 4 Drawing Figures

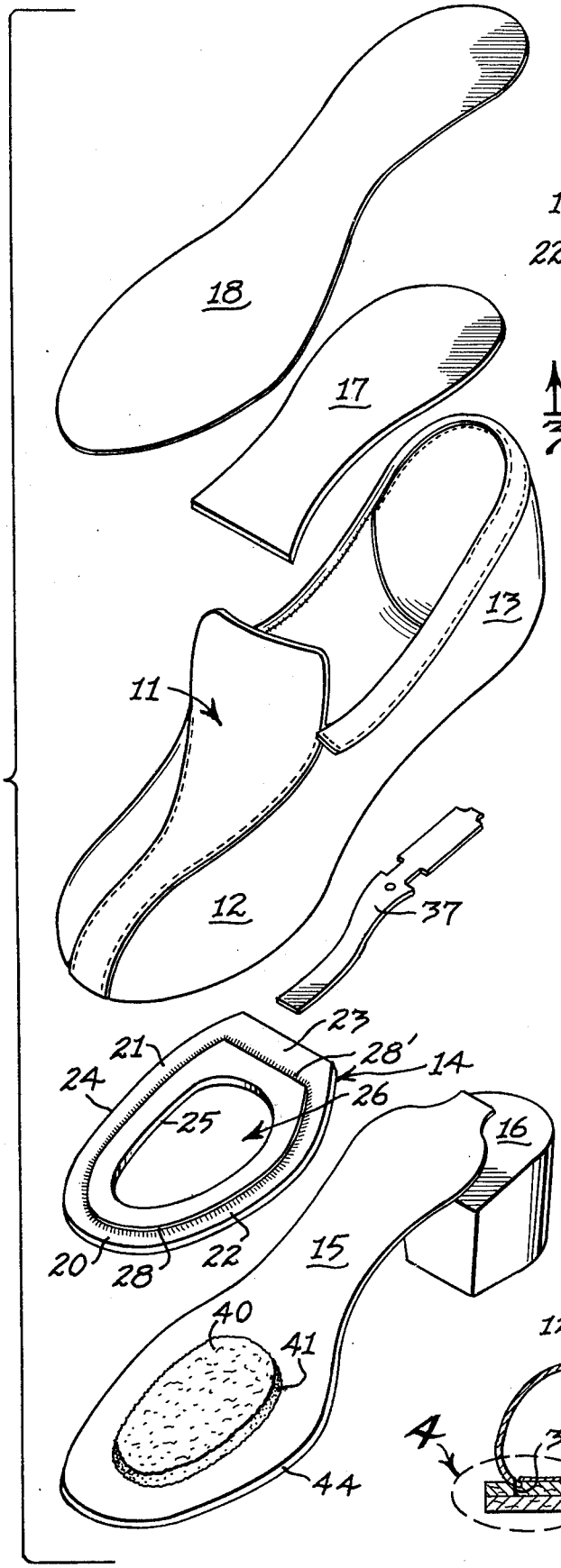
Fig. 1
Fig. 2
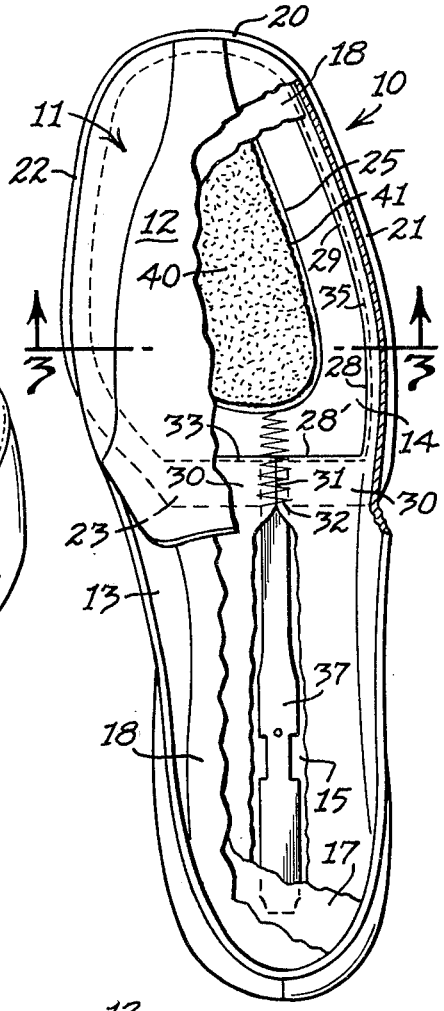
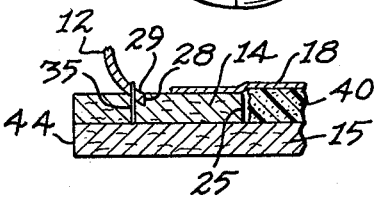
Fig. 4
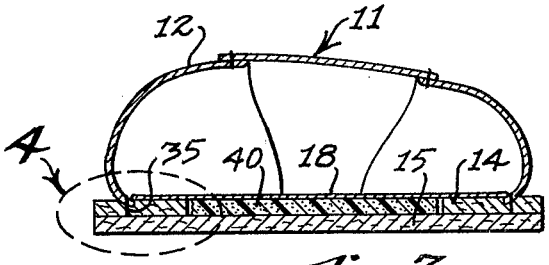
Fig. 3

FOREPART INSOLE RING SHOE CONSTRUCTION

BACKGROUND OF THE INVENTION

This invention relates to a shoe construction, and more particularly to a shoe construction incorporating a forepart insole ring member.

The U.S. Taylor Pat. No. 3,133,360 for "SHOE CONSTRUCTION HAVING UPPER SECURED WITHIN GROOVE OF SOLE RING," issued May 19, 1964, and having a common assignee with this application, discloses an insole ring member extending around the entire periphery of the shoe, including the forepart and the backpart portions. The full-length insole ring member of the Taylor patent is secured between the margins of the upper and the margin of the outsole. A full-length resilient or foam pad fixed to the outsole projects upward to fit within and conform to the hole defined by the inner edge of the full-length insole ring member.

Although the full-length insole ring member disclosed in the above Taylor patent provides a softness and flexibility not found in shoes having a full-length, solid insole member, nevertheless such a full-length insole ring member sacrifices some of the strength and stability found in a shoe having a solid insole member.

SUMMARY OF THE INVENTION

It is an object of this invention to provide a shoe construction in which the insole ring member is foreshortened and incorporated only within the forepart of the shoe. Thus, the forepart insole ring member, made in accordance with this invention, is about half the length of the insole ring member incorporated in the above Taylor U.S. Pat. No. 3,133,360.

In the shoe construction of this invention, no part of the ring member occupies the backpart portion of the shoe.

More specifically, the forepart insole ring member has a continuous outer edge and a continuous inner edge forming a hole in the middle thereof, and includes front, side and rear portions. The front and side portions are stitched, or otherwise secured, to the inturned margins of the forepart of the upper so that the outer edge of the side and front portions are coterminous with the corresponding edges of the forepart of the outsole. The rear portion of the forepart ring member extends entirely across the shoe in the ball area, and is secured by transverse stitching to inwardly turned depending parts of the upper quarters, and is secured on its bottom to the corresponding ball area of the outsole. A raised portion or resilient pad fixed to the top surface of the outsole projects upward through the hole in the forepart ring member to conform to the entire annular inner edge of the ring member.

The backpart portion of the upper, including the shank and heel areas are lasted in a conventional manner and secured, as by cement, to the backpart portion of the outsole.

The advantages of this forepart insole ring member are several. First of all, it has been found that the softness and flexibility provided by a full-length insole ring member are maintained by the half- or forepart ring member. As a matter of fact, there is somewhat more softness and flexibility in the backpart portion, and particularly in the shank area.

Furthermore, greater strength is provided by the forepart insole member because the shorter length of the forepart insole member provides greater stability and also because of the stabilizing or reinforcing effect of the transverse rear portion of the ring member extending across the ball area.

Another advantage is in the styling of the shoe. A shoe incorporating an insole ring member only in the forepart area presents the extra thickness of the insole member only around the forepart margin of the shoe. Thus, the extra sole thickness does not appear from the ball area rearward in any part of the backpart portion of the shoe. Therefore, a finer, tighter appearance is presented in the backpart area, since only the thickness of the outsole is visible in the backpart area. Furthermore, the appearance of the edge thickness of the insole ring member only in the forepart of the shoe presents an impression of strength and solidity in the sole area of greatest impact and wear, that is the forepart of the shoe sole.

BRIEF DESCRIPTION OF THE DRAWINGS

FIG. 1 is an exploded, top perspective view of the elements of a shoe made in accordance with this invention;

FIG. 2 is an enlarged, top plan view of the completed shoe, with portions broken away;

FIG. 3 is an enlarged section taken along the line 3—3 of FIG. 2; and

FIG. 4 is an enlarged fragmentary section identified by the dashed-line circle 4 in FIG. 3.

DESCRIPTION OF THE PREFERRED EMBODIMENTS

Referring now to the drawings in more detail, the shoe 10 made in accordance with this invention basically includes an upper 11 having a forepart 12 and a backpart 13, a forepart insole ring member 14, a full-length outsole 15 and a heel 16. The shoe 10 may also include a backpart insole member 17 and a full-length sock liner 18.

In the manufacture of the shoe 10, the pieces of the upper 11 are first cut out in the desired pattern and fixed together in a conventional manner, as disclosed in FIG. 1. The interior of the forepart 12 is provided with a box toe, not shown, while the interior of the backpart 13 is provided with a counter, not shown, in a conventional manner.

The outsole 15 may be formed from any conventional outsole material, which is preferably flexible.

The forepart insole ring member 14 includes a front or toe portion 20, opposite side portions 21 and 22 and a rear transverse portion 23 located in the ball area of the shoe 10. The forepart insole ring member also includes a continuous or annular outer edge 24 and a continuous annular inner edge 25 defining a hole or opening 26.

If desired, the top surface of the insole ring member 14 may be provided with an annular groove 28 having the sharp inner edge, and otherwise the same construction as the groove in the insole ring member disclosed in the above Taylor patent 3,133,360, for reception of the marginal edge portion 29 of the upper forepart portion 12.

In the preferred form of the invention, the quarters of the backpart portion 13 of the upper 11 are provided with depending shank portions 30 (FIG. 2), which are turned inward toward each other. The abutting edges 31 are secured together by the stitching 32. These shank portions 30 extend above the transverse rear portion 23 of the ring member 14, and are secured to the rear portion 23 by the transverse line of stitching 33 in the ball area of the shoe 10.

The groove 28 may be extended across the top surface of the rear portion 23 to form the groove portion 28′ to receive the front edges of the shank portions 30.

The marginal portion 29 of the forepart upper 12 is secured in the groove 28 along the side portions 21 and 22 and the toe portion 20 by the stitching 35.

After the forepart ring member 14 is secured by the stitching 35 and 33 to the corresponding portions of the upper 11, a pre-formed shank member 37 and the backpart insole member 17 may be secured to the backpart portion of the upper 13 in a conventional manner, such as by cement lasting.

The full-length outsole 15 is provided with a raised portion 40, preferably of a resilient or foam material, having an outer edge 41 conforming in shape to the inner edge 25 of the forepart sole member 14. Moreover, the foam pad member 40 is positioned on the top surface of the forepart of the outsole 15 so that it will fit within the hole 26 and register with the inner edge 25, while the outer edge 24 registers with the outer edge 44 of the forepart portion of the outsole 15. Then the outsole 15 is secured by appropriate adhesive to the entire bottom portion of the forepart ring member 14, the shank portions 30, the shank member 37 and the backpart insole member 17.

The heel 16 may be pre-attached to the outsole 15, or it may be attached after the outsole 15 has been secured to the upper 11.

The sock liner 18 is then inserted, and the completed shoe 10 then finished and packaged in a conventional manner.

It will be understood that the forepart insole member 14 need not include the groove 28 – 28′, in which event the marginal portion 29 of the forepart upper 12 may be stitched directly to the top of the forepart ring member 14.

The completed shoe 10 presents an appearance of solidity and strength in the forepart portion by virtue of the extra thickness of the outer edge 24 of the forepart ring member 14 and an appearance of superior styling in the shank and backpart areas because of the absence of any insole member in those areas.

Furthermore, the shorter length of the ring member 14, as well as the reinforcing and stiffening effect produced by the continuous transverse rear portion 23 of the forepart ring member 14 provides a stronger shoe than a shoe incorporating a full-length ring member, as disclosed in the above Taylor patent No. 3,133,360.

What is claimed is:

1. A shoe comprising:

a. an upper having an forepart margin and a backpart margin, b. a full-length outsole member having a forepart portion and a backpart portion joined by a ball area, and an outer edge, c. a forepart insole ring member between said upper and the forepart portion of said outsole member, d. said ring member having front and side outer edges coterminous with the outer edge of the forepart portion of said outsole member, and an inner edge, e. said ring member further comprising a rear portion extending transversely between said upper and said outsole member, said rear portion having an outer rear edge terminating in the ball area of said outsole member, f. means securing said ring member to the forepart margin of said upper, g. means securing the forepart portion and ball area of said outsole member to said ring member and the backpart portion of said outsole member to the backpart margin of said upper, and h. a raised portion on the forepart portion of said outsole member fitting within the inner edge of said ring member.

2. The invention according to claim 1 in which said upper further comprises a shank portion extending transversely of the shoe, and means securing the rear portion of said ring member to said shank portion.

3. The invention according to claim 1 in which the inner edge of said ring member is continuous to define a hole in the middle of said ring member, and the raised portion on said outsole member is complementary to said hole.

4. The invention according to claim 3 in which said raised portion on said outsole member comprises a resilient padded member projecting upward from said outsole member through said hole and above said ring member.

5. The invention according to claim 1 in which the means securing the forepart margin of said upper to said ring member comprises means securing the forepart margin of said upper to the side and front portions of said ring member spaced between the corresponding outer and inner edges of said ring member.

6. The invention according to claim 2 in which said shank portion comprises a pair of shank members projecting inwardly from the quarters of said upper, said shank members having abutting edges, means securing said abutting edges together, and said means securing the rear portion of said ring member to said shank portion comprises means securing said rear portion to both said shank members transversely of the shoe.

* * * * *